US007513020B2

(12) United States Patent
Giampavolo

(10) Patent No.: US 7,513,020 B2
(45) Date of Patent: Apr. 7, 2009

(54) SAFETY BUCKLE WITH MULTIPLE ORIENTATION CLASP

(76) Inventor: Paul Giampavolo, 10 Kingsbridge Rd., Fairfield, NJ (US) 07004

( * ) Notice: Subject to any disclaimer, the term of this patent is extended or adjusted under 35 U.S.C. 154(b) by 0 days.

(21) Appl. No.: 11/090,696

(22) Filed: Mar. 25, 2005

(65) Prior Publication Data

US 2005/0210641 A1 Sep. 29, 2005

Related U.S. Application Data

(63) Continuation-in-part of application No. 10/811,168, filed on Mar. 26, 2004.

(60) Provisional application No. 60/641,346, filed on Jan. 4, 2005.

(51) Int. Cl.
*A44B 11/25* (2006.01)
*A44B 11/26* (2006.01)

(52) U.S. Cl. ..... 24/625; 24/615; 24/662

(58) Field of Classification Search ..... 24/614–616, 24/625, 627, 633, 68 R, 662
See application file for complete search history.

(56) References Cited

U.S. PATENT DOCUMENTS

| | | | | | |
|---|---|---|---|---|---|
| 4,458,392 | A | | 7/1984 | Pogharian et al. | 24/664 |
| 4,712,280 | A | | 12/1987 | Fildan | 24/625 |
| 5,263,726 | A | | 11/1993 | Wood | |
| D359,464 | S | | 6/1995 | Grasso et al. | |
| 5,465,472 | A | * | 11/1995 | Matoba | 24/625 |
| 5,659,931 | A | | 8/1997 | Anscher | |
| 5,774,956 | A | * | 7/1998 | French et al. | 24/625 |
| 5,855,057 | A | * | 1/1999 | Anscher | 24/614 |
| 5,991,985 | A | * | 11/1999 | Galbreath | 24/625 |
| 6,000,109 | A | | 12/1999 | Anscher | |
| 6,138,330 | A | * | 10/2000 | Galbreath | 24/625 |
| 6,145,172 | A | * | 11/2000 | Bourdon | 24/625 |
| 6,163,942 | A | * | 12/2000 | Liao | 24/625 |
| 6,311,374 | B1 | * | 11/2001 | Anscher | 24/625 |
| 6,363,590 | B1 | * | 4/2002 | Lan | 24/614 |
| 6,446,314 | B1 | * | 9/2002 | Anscher | 24/614 |
| 6,662,414 | B1 | * | 12/2003 | Niewiadomski | 24/625 |
| 6,684,466 | B2 | * | 2/2004 | Nishida et al. | 24/615 |
| 6,728,999 | B2 | * | 5/2004 | Murai et al. | 24/615 |
| 2004/0226150 | A1 | * | 11/2004 | Beletsky | 24/625 |

(Continued)

FOREIGN PATENT DOCUMENTS

| | | |
|---|---|---|
| EP | 0 348 075 A1 | 12/1989 |

(Continued)

*Primary Examiner*—Robert J Sandy
*Assistant Examiner*—Ruth C Rodriguez
(74) *Attorney, Agent, or Firm*—Weingarten, Schurgin, Gagnebin & Lebovici LLP

(57) ABSTRACT

A child resistant buckle has two separate operations that are completed to permit the buckle to be disengaged. The buckle is provided as two interfitting components, which can be joined in at least two orientations while permitting the two operation disengagement to be maintained. The two operations may be sequentially or concurrent and can require a certain degree of force to permit actuation. The buckle composed of a plug and socket is oriented on a seat so that the plug is presented on a right hand side of a child and the socket is presented on a left hand side so that the clasped buckle is more difficult for the seated child to disengage.

19 Claims, 10 Drawing Sheets

U.S. PATENT DOCUMENTS

2005/0076483 A1* 4/2005 Chen ..... 24/615

FOREIGN PATENT DOCUMENTS

GB 2 150 632 A 7/1985
JP 07051106 A 2/1995
JP 08-84610 4/1996
JP 2001-61514 * 3/2001
WO WO 84/01275 4/1984

* cited by examiner

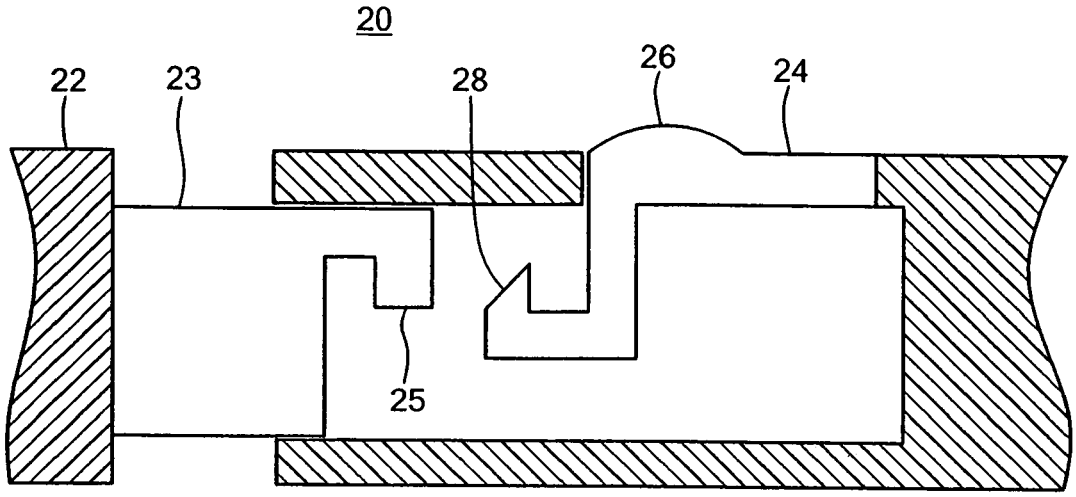
*FIG. 2* *Prior Art*
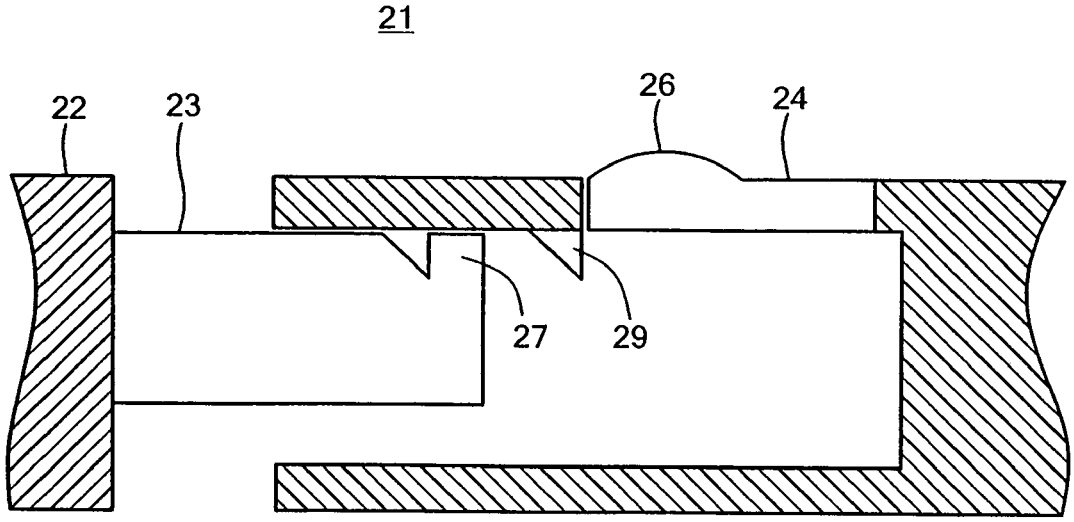
*FIG. 2a* *Prior Art*

SAFETY BUCKLE WITH MULTIPLE ORIENTATION CLASP

RELATED APPLICATIONS

This application is a continuation-in-part application of U.S. application Ser. No. 10/811,168, filed Mar. 26, 2004, and claims benefit of U.S. Provisional Application No. 60/641,346, filed Jan. 4, 2005, the entire contents of each being incorporated herein by reference.

STATEMENT REGARDING FEDERALLY SPONSORED RESEARCH OR DEVELOPMENT

N/A

BACKGROUND OF THE INVENTION

1. Field of the Invention

The present invention relates generally to safety buckles used with a strap, and relates more particularly to child resistant safety buckles for securing a child in a seat.

2. Description of the Related Art

Child resistant safety buckles are used in a number of applications including securing children in strollers, high chairs and shopping carts. A particular type of safety buckle is child resistant, to prevent children under a given age from releasing the buckle and freeing themselves, leading to a potentially dangerous or injurious situation. Although children under a certain age are prevented from unclasping the buckle, adults typically have no difficulty in disengaging the buckle to free the child. One type of buckle that is child resistant but can be opened by an adult has a double action feature to permit the buckle to be opened. That is, the buckle is opened by operating several disengaging elements to unlatch the buckle and disengage the buckle portions. By providing two actions to allow the buckle to be opened, the buckle is made child resistant, because a typical child under a certain age is unable to properly operate the two features, either sequentially or at the same time, for example, to unlatch and open the buckle. At the same time, an adult can easily and intuitively disengage the buckle by operating the two features as required.

A number of buckles are available that, while not designed to be child resistant, have security features, so that the buckles will not disengage unexpectedly. These types of buckles also have a multi-open feature, in that a number of operations must be conducted on the buckle to permit the buckle to be unlatched and opened. Typical applications for these type of buckles involve heavy duty or industrial uses, such as clasps for utility belts, sportswear or other applications, where the buckle is subjected to high loading or must be well secured.

One such high security buckle is shown in U.S. Pat. No. 5,774,956 to French et al., which discloses a buckle with flexible side release latches and a third latch accessible on the front of the buckle. The male portion of the buckle includes a central latch arm that engages the female portion of the buckle in a central portion, and is released by pressing on a central button on one side of the female buckle portion. The buckle unlatches when both side latch arms are moved inwardly, and the central arm is moved away from the catch on the female portion. The buckle unlatches when all three arms are moved to unlatched positions simultaneously. Changing the orientation of the male portion when inserted into the female portion results in the central arm catch being defeated, because there is no corresponding catch cooperation on the back side of the female.

U.S. Pat. No. 5,991,985 to Galbreath discloses a safety buckle with side catch arms and a central catch that engages with a depressible button catch on the female portion of the buckle. To disengage the buckle, the central button on the female portion of the buckle is depressed to either disengage from the central arm or displace the central arm to disengage from a catch. If the male portion of the buckle is inserted into the female portion of the buckle in an opposite orientation so that the central arm does not engage the depressible button catch, the buckle either does not clasp or the central arm does not latch.

U.S. Pat. No. 6,311,374 to Anscher shows a two-operation buckle with a center arm that includes a push button near the base of the male member with a catch near the push button to engage an opening catch in the female member when the buckle portions are engaged. In addition, the buckle is non-reversible, i.e., if the male member is inserted in an opposite orientation, so that the push button faces the back of the buckle assembly, the male and female members do not engage with each other.

U.S. Pat. No. 6,684,466 to Nishida et al. teaches a two-operation safety buckle in which the male member has a center arm with a catch recess that engages a catch on the female member. The center arm of the male member is displaced downwardly during insertion to permit the latch member to protrude into the latch recess when the male member is fully inserted and the center arm returns to its undisplaced position. The center arm is disengaged from the catch with a button on the female member that is pressed to displaced the center arm away from the catch of the female member, so that the male member can be withdrawn from the female member, with the sidearms being depressed together. This buckle configuration is not reversible, in that if the male is inserted in an opposite orientation, the center arm does not latch with the female latch member. Due to the shape of the buckle components, high stress environments may have a further adverse impact on the buckle. For example, if the buckle deforms, a situation where the buckle can be clasped but not unclasped may occur.

U.S. Pat. No. 6,138,330 to Galbreath discloses a two-operation safety buckle in which the sidearms of the male member are prevented from being squeezed together to unlatch the buckle, when the male and female members are engaged together. A blocking device in the female member engages with the latching arms of the male member to prevent their displacement and thus prevent them from being unlatched until the blocking device is displaced away from the latching arms to permit their relative movement. Accordingly, the blocking device is first displaced, and then the arm latches are displaced towards each other until they are free of their respective latches in the female member, at which point the male member can be withdrawn from the female member. The configuration of this buckle permits the male member to be inserted in the female member in an opposite orientation. The blocking device and arm latching functions of this buckle are not independent of each other when the buckle is in a clasped condition. The arms are prevented from being operated due to the blocking device, which is first displaced away from the arms before they may be operated. This blocking of the arms in a sequential function represents a major difference from other conventional buckles where the latching mechanisms remain independently functional in the clasped condition. This difference is significant to operation in a commercial environment where buckles are subject to forces that routinely alter their shape. Even slight forces may deform a given buckle, resulting in the buckle being prone to jamming.

Moreover, the buckle of the '330 patent is difficult to manufacture due to practical tolerance limitations in the materials and the amount of area within the confines of the buckle interior. In addition, the buckle configuration is not designed to withstand high impact or compressive forces that are typically encountered in safety buckle applications. The combination of small manufacturing tolerances and lack of resilience to environmental factors contribute to operational problems. For example, small changes in tolerances due to impact or compressive forces, or through extreme temperature ranges, may influence operation of the blocking device leading to buckle failure.

A particular failure mode that is highly undesirable occurs when the deformed buckle can be easily clasped, but becomes extremely difficult to unclasp. Often, such failed buckles may respond to the application of brute force to be opened, such as the application of a high tensile force or prying force. However, a buckle with a blocking action does not respond to brute force methods to open the buckle due to the particular nature of the blocking mechanism design. In such a situation, the belt attached by the buckle is cut away to free the occupant, destroying the usefulness of the belt and buckle.

In each of the above two-operation safety buckles, a change in the orientation of the male member when being inserted into the female member causes the buckle either not to clasp, or defeats the operation of the second operation needed to unclasp the buckle. In a case of the '330 patent to Galbreath, reversing the orientation of the male member does not defeat the two-operation feature of the buckle. However, since the blocking device in the buckle makes the latching mechanisms dependent on each other, the buckle is more difficult to manufacture and operate in practice. In addition, there are challenges to making the buckle of the '330 patent to Galbreath impact resistant or durable in stressful environments. For example, if the buckle becomes deformed due to impact or compression, it is extremely difficult to unlatch the buckle.

Indeed, conventional buckles are made with materials that are inexpensive to avoid increased costs for the buckle components and seatbelts overall, for example. Low cost materials, such as acetal, tend to be brittle and somewhat inflexible, and the structural elements tend to be more difficult to operate. Accordingly, the structural elements that are manipulated to operate the buckle are minimized to maintain the operational characteristics of the buckle and permit the structural elements to be more easily operated. However, this minimization tends to limit the operational robustness of the manipulated structural elements.

A number of factors may contribute to improving child resistant features in a child restraint system. However, to date few factors have been identified as contributing to child resistancy. It would be desirable to identify and implement child resistant factors in a reversible or multi-orientation buckle.

Furthermore, it would be desirable to obtain a two-operation safety buckle that is independent of the orientation of the male member in the female member that provides robust operation in practice with ease of manufacturability.

BRIEF SUMMARY OF THE INVENTION

In accordance with the present invention, there is provided a two-operation safety buckle in which the male member may be inserted in a random orientation while preserving the functionality of the two-operations to unlatch the buckle. The invention is accomplished by modifying either the male or female member to provide an orientation balanced latching mechanism that exhibits functional symmetry.

In accordance with a first embodiment of the present invention, a male member is provided with a center arm having a projection for latching with a female portion of a buckle. The latching projection of the male member is provided on either side of a center arm of the male member, so that the male member latches with a single mating latch on the female member independent of the orientation of the male member. The male member is disengaged from the female member by displacing the center arm away from the female latch member, while displacing a pair of sidearm latches towards each other so that the male portion of the buckle is free to be disengaged from the female portion of the buckle. Although the latching projections generally need not be physically symmetrical, they exhibit functional symmetry in that one of them engages in at least one random orientation of the clasped buckle.

In accordance with another embodiment of the present invention, two female latch members are provided on either side of an inner chamber of the female portion of the buckle. A mating latch projection is provided on the center arm of the male portion of the buckle, so that the engagement and latching of the male and female portions is independent of the orientation of the male member.

In accordance with either of the previous embodiments, variations thereof may include one or more buttons on the female member for disengaging the latch members, or one or more buttons on the male member. The various buttons may control the latching members by displacing a latching member that is connected directly to the one or more buttons, or by displacing the center member by contact and thereby disengaging the latching members.

In accordance with another embodiment of the present invention, an aperture is provided on the center arm of the male member for receiving a single latch projection extending from a side of the female inner chamber. Engagement and disengagement is controlled by a thumb tab on the female member be which the latch projection can be inserted and removed from the aperture.

In yet another embodiment of the present invention, the male member is not provided with a center member. The pair of sidearm latches are provided with a grooved surface for engaging a latching projection on the inner surface of the female Member. The sidearm latches are disengaged from the latching projection by a button on the female member, which, when activated, displaces the sidearms away from the latching projection.

According to a feature of the present invention, a female member of a buckle is provided with a slot that cooperates with a center arm of a male member to provide enough clearance for the center arm of the male member to be displaced a distance sufficient to unlatch the center arm from a catch projection on the female. The slot, or trench, permits the center arm to be displaced a greater distance to perform an unlatching function. The greater displacement capability of the center arm permits the catch projection on the female member to be extended, so that a more secure child resistant feature can be provided.

In accordance with another feature of the present invention, a center arm of a male buckle member includes a recess, which in an exemplary embodiment is a through opening, to cooperate with a catch protrusion in the female buckle member. By providing the recess or through opening, a longer catch protrusion may be used on the female buckle member to interact with the center arm to secure the buckle. The use of the longer catch protrusion on the female permits the buckle to be more securely clasped and improves the child resistant feature of the buckle.

In accordance with another feature of the present invention, a center post of a male buckle member is tapered to improve a release action from a catch in the female buckle member. The center post may be tapered near an end of the center post, so that the center post need not be displaced as great a distance to enable the buckle to be more easily released when the center post is displaced to be free of the female buckle member catch protrusion. The tapered center member may be provided in combination with the recess or through opening in the center member to provide additional latch security for the center member and catch protrusion, while permitting the latch to be easily released. The slot or trench feature provided in the female buckle member may also be used with the taper and recess feature to permit the center member to be displaced a greater distance to improve latch reliability while obtaining a smooth and easy release.

In accordance with another feature of the present invention, the child resistancy of a two-operation buckle may be improved by providing a gap between a latch actuator and the latch. Such a gap provides a non-functioning range of operation, so that it tends to actuate the latch to not operate to unlatch the latch until the actuator has been displaced across the gap, or through the range of non-operation, to cause the actuation of the latch to perform an unlatching function. Accordingly, children attempting to actuate the latch in an unlatching operation by operating the actuator observe no results over the range of non-operability, so that the child is less likely to be able to unlatch the latch.

The buckle of the present invention is composed of a flexible and durable material designed to withstand impact or compressive forces to avoid, for example, permanent deformation of the buckle and create a more robust structure. The buckle may be molded from a variety of materials. These materials may include LDPE, HDPE, ABS, polystyrene, polypropylene sulfides, acetals, polycarbonates, thermoplastic rubbers, and polyesters, among others. According to a feature of the present invention the buckle is composed of a material that is both durable and flexible, such as, for example, impact modified nylon. The use of such a material permits the buckle to have operative structural elements that have greater structural integrity, such as by increasing a dimension of the structural element or elements, without significantly increasing operational difficulty. The selection of such a material contributes to the overall integrity of buckle operation, because it is durable enough to withstand high impact or compressive forces, while permitting the operative structural elements to be relatively easy to operate, even if increased in dimension.

According to another feature of the present invention, the buckle is formed to have latching arms in the male portion that exhibit a particular force resistance to being compressed together. According to this feature, a child is typically unable to compress the latching arms of the male member sufficiently to disengage the buckle, even if a second latching mechanism is unlatched. The force should be sufficiently low to permit an adult to easily operate the buckle. In an exemplary embodiment, a minimum force to actuate the latching arms is 5 lbs or greater to prevent operation by a child. The actuating force can also be less than a maximum force of 16 lbs to permit operation by an adult.

The selection of materials for the present invention also contributes to maintaining the child resistant features in harsh environments. For example, the selection of high impact nylon, provided by Dupont as material ST801, permits the child resistant buckle to absorb impact and compressive loading forces without permanently deforming to avoid the loss of child resistant features. The selection of the impact modified nylon also permits tolerances in the manufacture of the buckle to be maintained, even in harsh environments where the buckle is subjected to high impact or compressive forces, or wide variations in temperature. Accordingly, the selection of the material further improves the child resistant features of the buckle by maintaining those features even in outdoor environments or harsh environments, such as when the buckle is used in a shopping cart seatbelt.

Other features and advantages of the present invention will be apparent from the following detail description to be read with the accompanying drawings as described below.

BRIEF DESCRIPTION OF THE DRAWINGS

FIG. 2 illustrates a central cross-sectional side view of a second conventional two-operation safety buckle;

FIG. 2*a* is a central cross-sectional side-view of another conventional two-operation safety buckle;

DETAILED DESCRIPTION OF THE PREFERRED EMBODIMENT

Figure 1A:
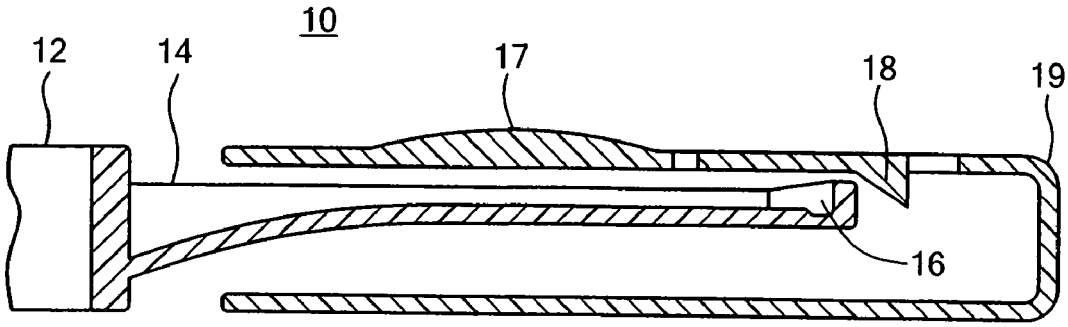
FIG. 1a Prior Art
FIGS. 1*a* through 1*c* illustrate a central cross-sectional view of a conventional two-operation safety buckle.
Figure 1B:
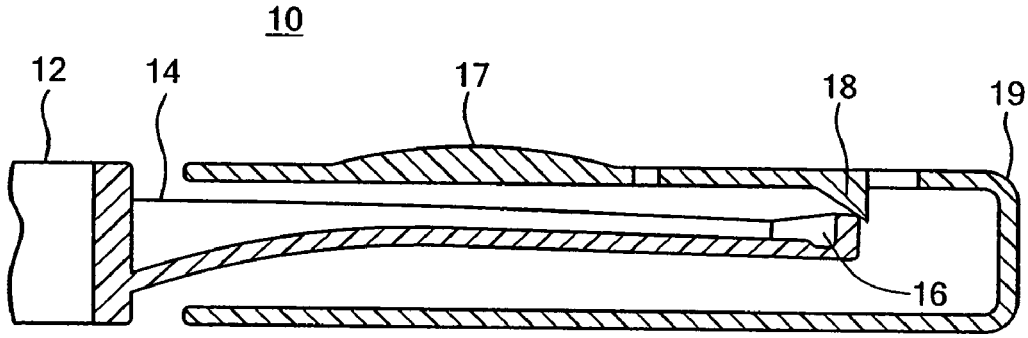
FIG. 1b Prior Art
Figure 1C:
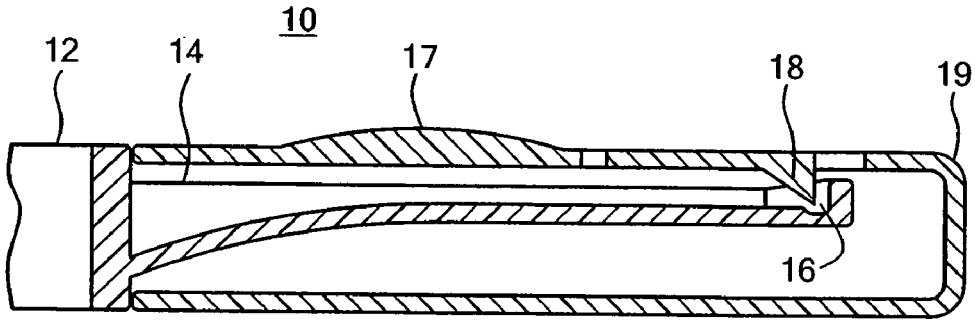
FIG. 1c Prior Art

FIGS. 1*a* through 1*c* illustrate a central cross-sectional side view of a conventional two-operation safety buckle 10. Buckle 10 comprises a male member 12 having a center arm 14 with a catch recess 16 that engages a catch 18 on the female member 19. As illustrated in FIG. 1*b*, the center arm 14 of the male member 12 is displaced downwardly during insertion to permit the latch 18 to protrude into the latch recess 16 when the male member 12 is fully inserted and the center arm 14 returns to its undisplaced position, as seen in FIG. 1*c*. A button 17 is located on female member 19 for disengaging central arm 14 from the catch 18. Processing button 17 displaces center arm 14 away from catch 18 of the female member 19, so that male member 12 can be withdrawn from female member 19. Buckle 10 is not configured to be reversible, meaning that if male member 12 is inserted in an opposite orientation, with center arm 14 facing a bottom of female member 19, center arm 14 does not engage latch 18.

Referring now to FIG. 2, a central cross-sectional side view of a second conventional safety buckle 20 comprising a male member 22 and a female member 24 is illustrated. Male member 22 includes a central arm 23 having a latch 25. Female member 24 includes a depressible button 26 controlling a catch 28. When male member 22 is inserted into female member 24, latch 25 is engaged by catch 28, providing a child safety locking feature.

Male and female members 22, 24 are engaged with conventional side latches (not shown) and latch 25 cooperating with catch 28. Latch 25 rides over a sloped surface of catch 28 to displace catch 28 and button 26 downward until latch 25 slides past catch 28. Once latch 25 slides past catch 28, catch 28 is free to resiliently return to a normal position along with button 26, thereby latching buckle 20.

To disengage buckle 20, button 26 on female member 24 is depressed to disengage catch 28 from latch 25 on central arm 23 while the side latches are disengaged.

Another conventional embodiment of a two action buckle 21 is shown in FIG. 2*a*. Buckle 21 operates by providing a latch 27 on male member 22 that engages a catch 29 on female member 24. When buckle 21 is disengaged, pressing button 26 displaces central arm 23 so that latch 27 is free of catch 29, and male and female members 22, 24 can be separated by also pressing sides arms (not shown) on male member 22 to disengage the side arms from cooperating recesses (not shown) on female member 24.

Similar to the previously described conventional safety buckle 10 as illustrated in FIG. 1, if central arm 23 of male member 22 is inserted into female member 24 of buckles 20 or 21 in an opposite orientation, then latches 25, 27 of central arm 23 do not engage catches 28, 29, thereby bypassing the two-operation child safety feature. This orientation dependence of the buckle clasp leads to the results that buckles 20, 21 do not clasp at all, or buckles 20, 21 clasp without engaging the secondary child safety lock. It is possible in these instances that the lack of engagement of the child safety lock is unobservable, so that the buckle appears secure when the two-action open feature is actually defeated.

Figure 3:
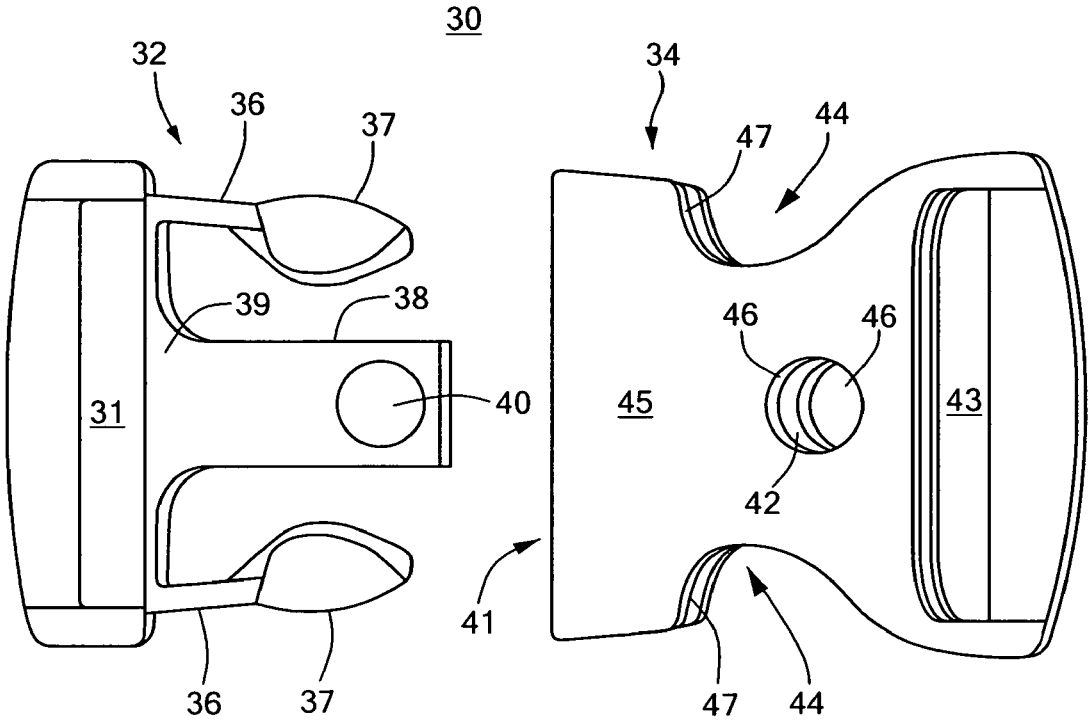
FIG. 3 illustrates a plan view of a first embodiment of a male and female portion of a two-operation safety buckle according to the present invention.

Referring now to FIG. 3, a first embodiment of a two-operation safety buckle 30 according to the present invention is illustrated. Safety buckle 30 is composed of a male member 32 and a female member 34. Male member 32 includes sidearms 36 and a center arm 38 connected to a base 39. A distal end of a sidearms 36 has enlarged heads 37. Center arm 38 has a latch projection 40 extending from a distal end 39 thereof. Extending through base 39 opposite from heads 37 is strap recess 31 for receiving a belt or other fastening instrument. Female member 34 includes an inner cavity 42 with an open end 41. Female member 34 also includes strap recess 43 for insertion of a strap or other band equivalent. Recesses 44 are provided on sides of female member 44 for receiving heads 37 of male member 32. Recesses 44 are positioned and sized to receive heads 37 at full insertion of male member 32 and are sized to allow arms 36 to resiliently return to an initial position, or a less loaded position, after being received by recesses 44.

In accordance with the present invention, a top and bottom surface of female member 34 are provided with openings 46 for receiving latch projection 40, independent of the orientation of male member 32. That is, male member 32 is securely received in female member 34 to engage heads 37 and projection 40 without regard to whether projection 40 extends toward or away from a surface 45 of female member 34. Upon insertion into female member 34, center arm 38 is biased toward a side to which latch projection 40 extends. Biased center arm 38 and latch projection 40 are sized to fit in cavity 42 of female member 34. When male member 32 is fully inserted, biased center arm 38 drives the projection 40 into opening 46 to create a second latch feature for added child safety.

When male member 32 is inserted and secure in female member 34, in either orientation, buckle 30 is unclasped with two actions, pressing projection 40 to be free of opening 46, and pinching heads 37 to be free of shoulders 47. These actions may be coordinated or sequential to unfasten buckle 30. Optionally, projection 40 may be brightly colored to assist in releasing buckle 30.

Figure 4:
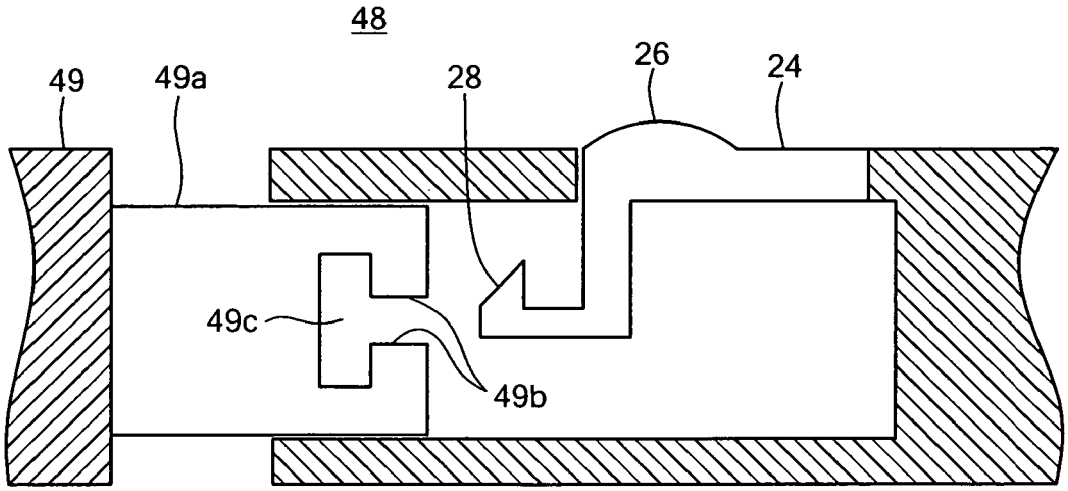
FIG. 4 illustrates side cross-sectional view of a second embodiment of a two-operation safety buckle according to the present invention.

Referring now to FIG. 4, a cross-sectional side view of another embodiment of the reversible two-action safety buckle is illustrated as buckle 48.

Buckle 48 includes conventional female buckle 24, as illustrated in FIG. 2, and male buckle portion 49 in accordance with the present invention. Male buckle 49 includes central arm 49*a* with symmetrical latches 49*b*. Latches 49*b* engage catch 28 when male buckle portion 49 is in either orientation, that is, male buckle portion 49 may be reversed and symmetrical latches 49*b* are separated by a distance sufficient to permit catch 28 to be inserted and removed from a cavity 49*c* to permit latching and unlatching actions. Buckle 48 is released from a clasped configuration by depressing button 26 to disengage catch 28 from an engaged latch 49*b*.

Figure 5:
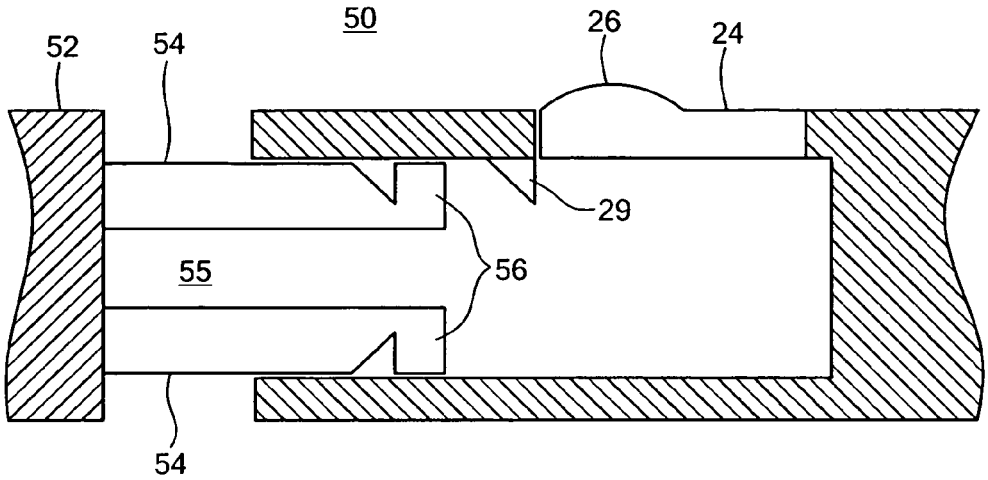
FIG. 5 illustrates a cross-sectional side view, of a two-operation safety buckle according to the present invention.

Referring now to FIG. 5, a buckle 50 according to the present invention is illustrated with a female member having similar construction to female member 24 of FIG. 2*a*. Buckle 50 however includes a male member 52 with central arms 54 that engage catch 29 with one of latches 56. When male portion 52 engages female portion 24, latch 56 rides over catch 29 and returns resiliently to a less flexed position where latch 56 and catch 29 are engaged. Arms 54 are separated by a space 55 to permit arms 54 to flex towards each other without interference from the opposite arm 54. Male and female members 52, 24 are disengaged by pressing button 26 to deflect arm 54 downward until latch 56 is free of catch 29. At the same time, side arms (not shown) are pinched together to be disengaged from cooperative retaining shoulders (not shown) to permit male and female members 52 and 24 to be separated. Because male member 52 include symmetrical arms 54 with symmetrical catches 56, male member 52 can be reversed in orientation and still provide a secondary latching feature in buckle 50.

Figure 6:
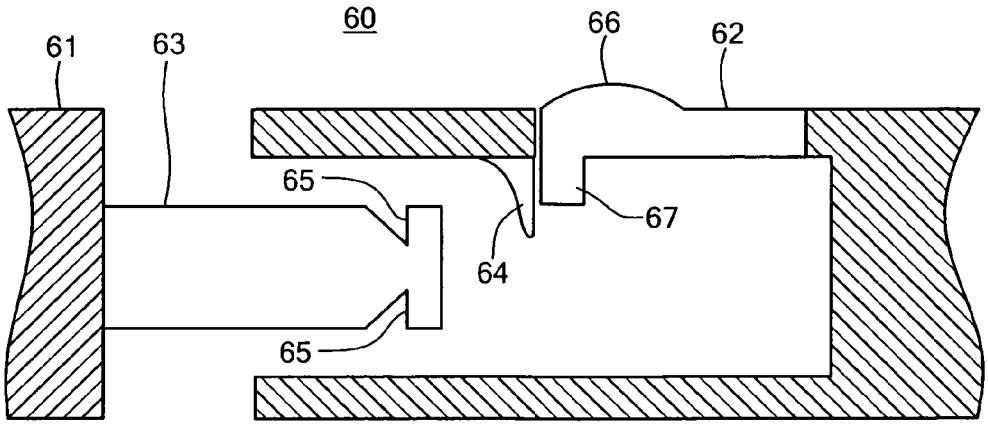
FIG. 6 illustrates a cross-sectional side view of another embodiment of a two-operation safety buckle according to the present invention.

Referring now to FIG. 6, a two-action reversible buckle 60 according to the present invention is illustrated. Buckle 60 includes male and female members 61,62 that securely cooperate to provide a safety buckle clasp. Male member 61 includes a central arm 63 that is resiliently flexible to contribute to a secondary latching feature of buckle 60. Arms 63 includes latches 65 that engage with a catch 64 when male member 61 is completely inserted into female member 62. As an end of central arm 63 is inserted into female member 62, it meets with and is deflected by catch 64. As male member 61 continues to be inserted into female member 62, central arm 63 is deflected until latches 65 move past catch 64, at which point central arm 63 resiliently returns to a less flexed position. A secondary latching feature of buckle 60 is thus engaged. To disengage male and female members 61,62, button 66 of female member 62 is depressed, causing displacement surface 67 to contact and displace latch 65 away from catch 64. Once latch 65 is free of catch 64, male member 61 can be disengaged from female member 62 by also pinching the side arms (not shown) of male member 61 to free them from their cooperating shoulders (not shown) on female member 62. Central arm 63 of male member 61 is symmetrical about a central axis of male member 61, such that male member 61 may be inserted into female member 62 in either orientation, i.e., orientations of male member 61 that are separated by 180 degrees with respect to a central axis of male member 61.

Figure 7:
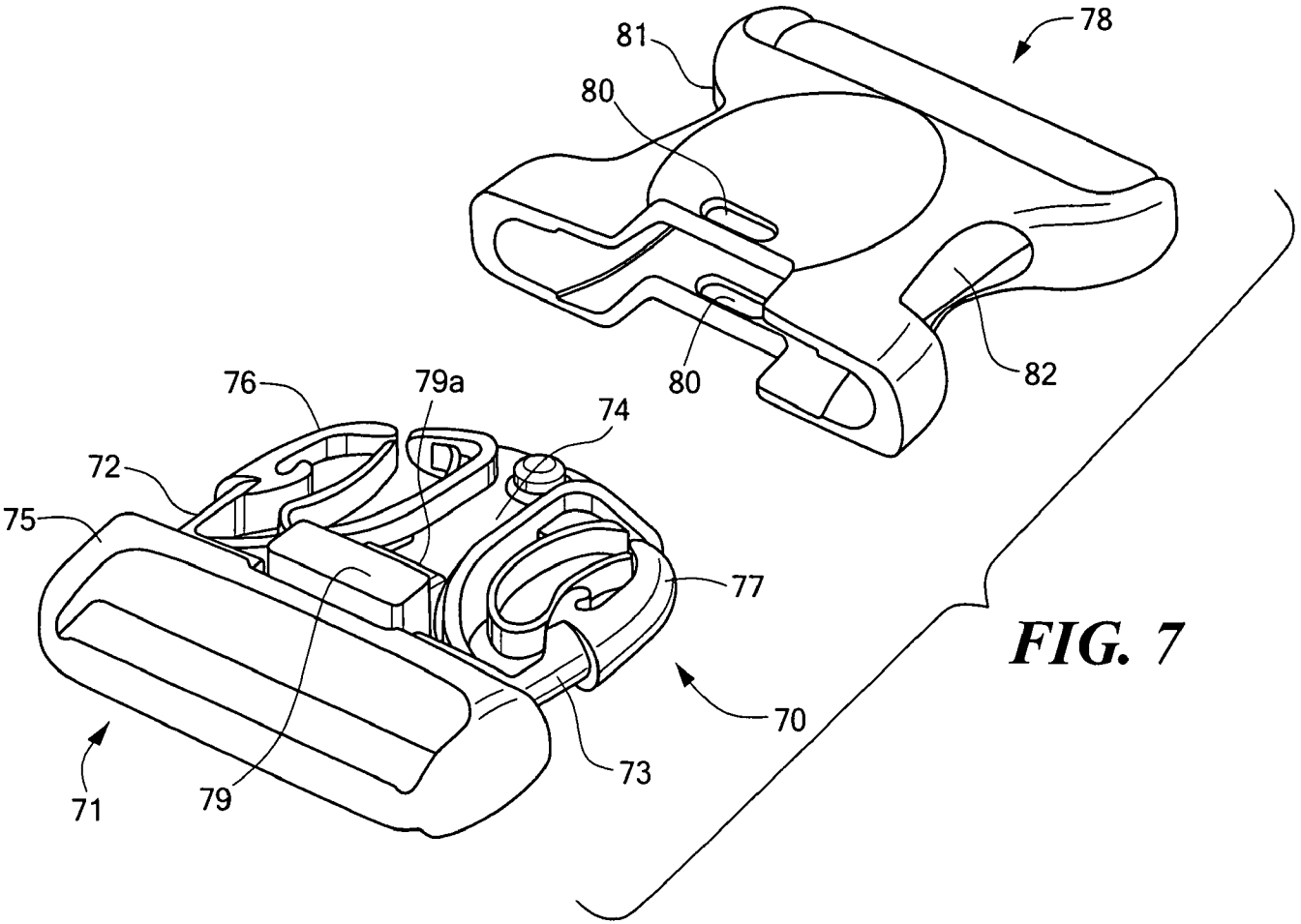
FIG. 7 illustrates a perspective view of another embodiment of a two-operation safety buckle according to the present invention.

Referring now to FIG. 7, a reversible two-action buckle assembly 70 according to the present invention is illustrated. Buckle assembly 70 includes a plug 71 with side arms 72 and 73, and a central arm 74, all connected to a base 75. Side arms 72 and 73 includes catches 76 and 77, respectively, that cooperate with corresponding catches on a socket 78. Central arm 74 has an integral lever formed with a free end having a pushbutton 79. A latch 79*a* is located adjacent to pushbutton 79. Latch 79*a* cooperates with catch 80 located on an upper and lower surface of socket 78. Socket 78 also includes openings 81,82 for receiving catches 76,77, respectively. Accordingly, when plug 71 is inserted into socket 78, latch 79*a* engages catch 80, independent of the orientation of plug 71 with respect to socket 78. Because socket 78 is symmetrical with respect to the insertion of plug 71, buckle 70 provides a two-action securing feature when plug 71 and socket 78 are fastened together in either orientation. Plug 71 and socket 78 are disengaged by depressing button 79 to displace latch 79*a* so that latch 79*a* is free of catch 80. Catches 76,77 are pinched together, before, at the same time or after button 79 is depressed, to free catches 76,77 from the cooperating latches in openings 81,82. Once catches 76,77 and latch 79*a* are free of their respective cooperating openings 81,82 and catch 80, plug 71 and socket 78 can be separated.

Figure 8:
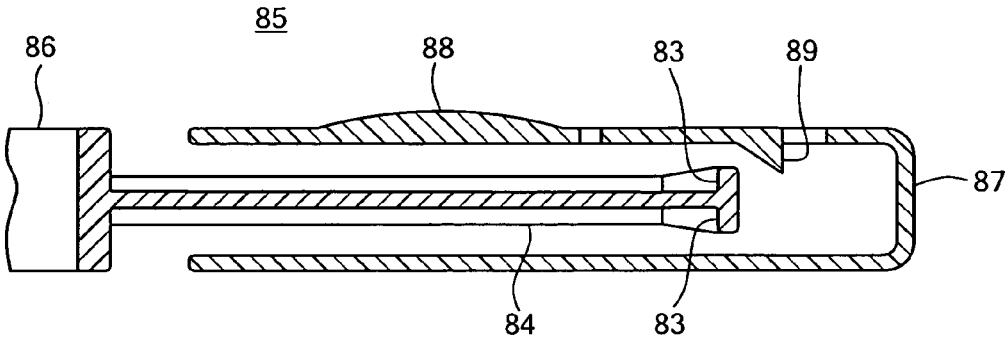
FIG. 8 illustrates a cross-sectional side view of a two-operation safety buckle according to the present invention.

Referring now to FIG. 8, a buckle 85 according to the present invention is illustrated with a male member 86 and a female member 87. Female member 87 includes a button 88 and a catch 89 for disengaging and engaging a central arm 84 of male member 86. Central arm 84 includes latches 83 that engage with catch 89 when male member 86 is inserted into female member 87 in either orientation. Latches 83 are disengaged from catch 89 by depressing button 88, which contacts and deflects central arm 83 to displace latches 83 so that latches 83 are free of catch 89. Because central arm 84 is symmetrical with respect to an axis of male member 86, for example, male member 86 can be inserted into female member 87 in either orientation and obtain a secondary latch feature through the cooperation of latches 83 and catch 89. Catch 89 also includes a sloped surface to permit central arm 84 to be flexibly displaced when male member 86 is inserted into female member 87, so that central arm 84 can resiliently return to a loaded or unloaded state when latches 83 and catch 89 cooperate.

Figure 9:
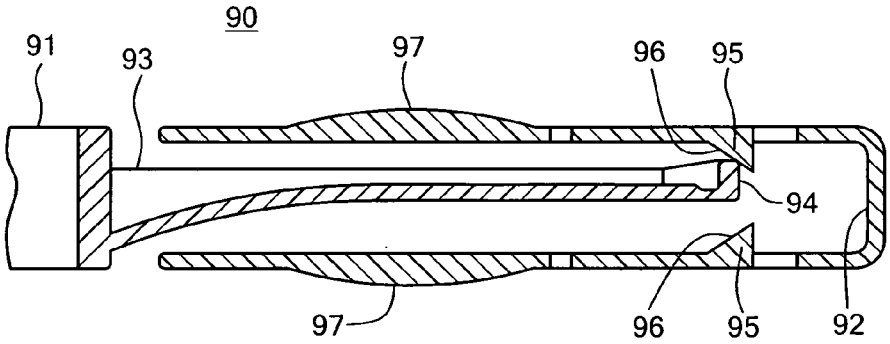
FIGS. 9 and 9A illustrate a cross-sectional side view of further embodiments of a buckle according to the present invention.

Referring now to FIG. 9, a buckle 90 according to the present invention is illustrated with a male member 91 and female member 92. Male member 91 has a central arm 93 with a latch 94 that cooperates with catches 95 on female member 92. Catches 95 include sloped surfaces 96 that deflect the front end of central arm 93 when male member 91 is inserted into female member 92. Central arm 93 resiliently flexes as latch 94 rides over sloped surface 96, until latch 94 passes catch 95, at which point central arm 93 resiliently returns to an unloaded or loaded state, depending upon the relationship of catch 95 and latch 94. At that point, male member 91 is secured in female member 92 by the cooperation of latch 94 and catch 95.

Female member 92 includes buttons 97 that are flexibly depressed to contact central arm 93 and defect central arm 93 so that latches 94 can move away from catches 95 to permit male member 91 to be disengaged from female member 92. Buttons 97 are stiff so that pinching buttons 97 together do not interfere with the displacement of central arm 93 to free latch 94 from catch 95.

Figure 9A:
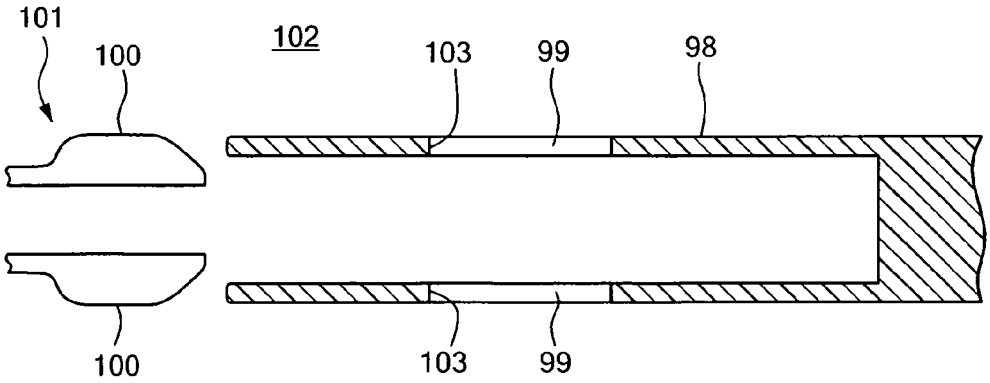

Referring now to FIG. 9*a*, a simplified female member 98 according to the present invention includes two openings 99 sized and shaped to receive two central prongs 100 of a male member 101. Prongs 100 are received in both openings 99 of female member 98 to secure male member 101 within female member 98. According to this embodiment, buckle 102 is unclasped by pinching two side arms (not shown) to free the side arms from their cooperating catches (not shown) on female member 98, while also pinching prongs 100 to free them from cooperating catches 103 of female member 98. Buckle 102 thus requires two separate pinching actions to unclasp male and female members 101, 98, thereby providing a double action, reversible, child resistant buckle.

It should be apparent that prongs 100 and openings 99 could be provided on a single side or surface of buckle 102. In such a configuration, buckle 102 is a two-action buckle, with prongs 100 and openings 99 alone, and the side arms and cooperating catches could be eliminated.

Figure 10:
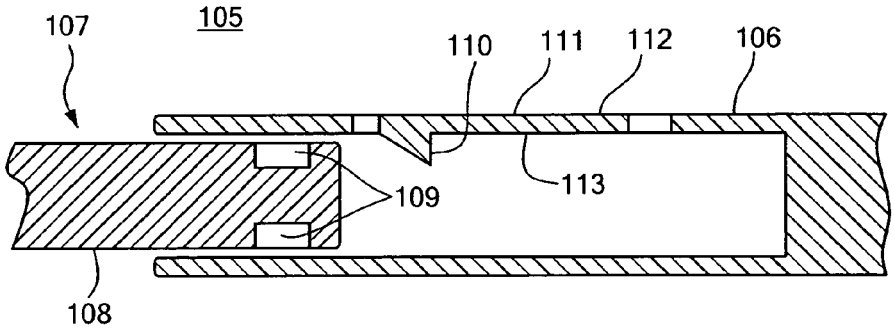
FIG. 10 illustrates a cross-sectional side view of another embodiment of a two-operation safety buckle in accordance with the present invention.
Figure 11:
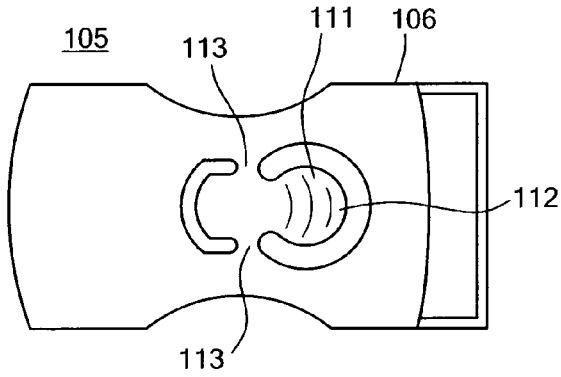
FIG. 11 illustrates a plan view of a female buckle portion according to the embodiment of FIG. 10.

Referring now to FIG. 10, another embodiment of the reversible double action buckle according to the present invention is illustrated as buckle 105. Buckle 105 includes female member 106 and male member 107, with central arm 108 being attached to male member 107. Central arm 108 has a cross-sectional dimension that provides small clearances when inserted into female member 106 to improve the stability of the coupling of male member 107 and female member 106. Central arm 108 also includes recesses 109 that cooperate with catch 110 on rocker arm 111 of female member 106. Accordingly, when central arm 108 is inserted into female member 106, recesses 109 and catch 110 cooperate to prevent male member 107 from being removed from female member 106. Aside from pinching side arms (not shown) to free them from cooperating catches (not shown) on female member 106, male member 107 is released from female member 106 by depressing a button 112 on rocker arm 111 to pivot rocket arm 111 about a fulcrum 113 to displace catch 110 upwards so that catch 110 is free of recesses 109. Once catch 110 is free of recesses 109, central arm 108 can be withdrawn from female member 106, as long as other latches and catches are disengaged. Because central arm 108 is symmetrical about an axis of male member 107, the latching of recesses 109 with catch 110 is independent of the orientation of female member 107 with respect to central arm 108. Optionally, button 112 can be provided with a message or a bright color to indicate that buckle 105 may be unlatched by depressing button 112.

Figure 12:
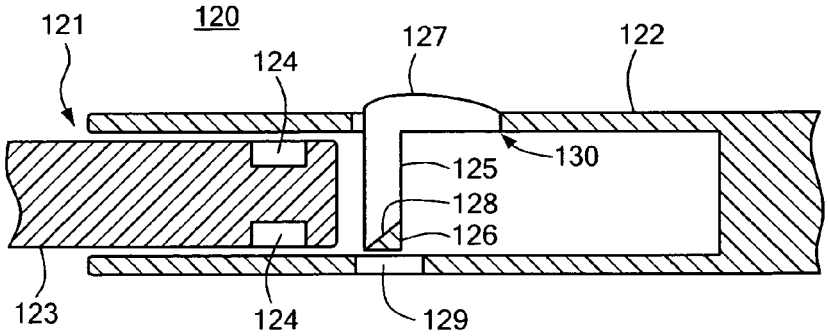
FIG. 12 illustrates a cross-sectional side-view of another embodiment of a reversible two-operation safety buckle in accordance with the present invention.

Referring now to FIG. 12, another embodiment of the reversible, double action buckle according to the present invention is illustrated as buckle 120. Buckle 120 includes male member 121 and female member 122. Male member 121 includes a central arm 123 that includes recesses 124. Female member 122 includes a catch 126 on a pivot arm 125 that is coupled to a button 127. Catch 126 includes a sloped surface 128 that cooperates with an end of central arm 123.

Central arm 123 contacts surface 128 to displace arm 125, catch 126 and button 127 downward through an opening 129 in female member 122. As male member 121 is inserted further into female member 122, recesses 124 cooperate with catch 126 to retain central arm 123 in female member 122. Arm 125 resiliently pivots about a point 130 to permit central arm 123 to slide past catch 126, and to permit arm 125 to return to an upright position so that catch 126 engages recesses 124 when male member 121 is fully inserted into female member 122. In this embodiment, central arm 123 may be composed of two parallel central arms side-by-side that both have recesses 124 and both engage catch 126. Alternatively, a single central arm can be provided that slides past one side of arm 125 to permit catch 126 to engage recess 124. In either instance, central arm 123 is symmetrical about an axis of male member 121 so that catch 126 and recess 124 engage each other independent of the orientation of male member 121.

Male member 121 and female member 122 are released by disengaging all other latches in buckle 120, and depressing button 127 to displace catch 126 into opening 129. As catch 126 is displaced into opening 129, catch 126 is free of recess 124 so that central arm 123 may be disengaged from female member 122. The embodiment of buckle 120 provides additional stability because of the smaller clearances between central arm 123 and female member 122 than would be provided if central arm 123 were made to flex, as is the case in other embodiments described above.

Figure 13:
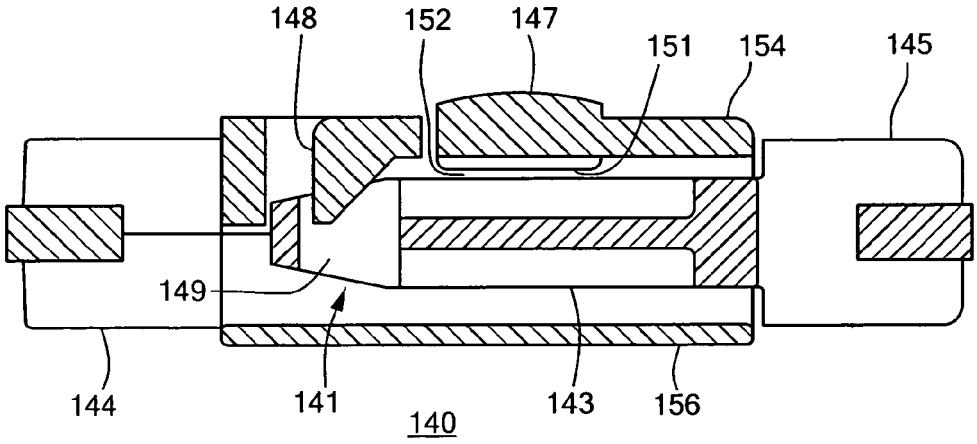
FIG. 13 is a cross-sectional side-view of a clasped buckle according to an embodiment of the present invention.
Figure 14:
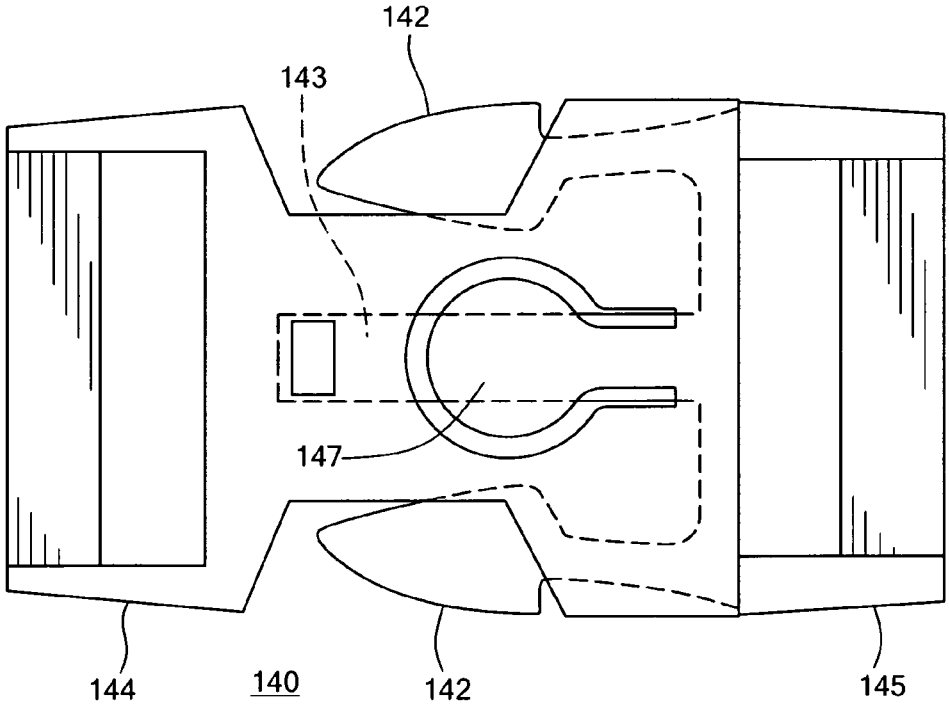
FIG. 14 is a plan view of the clasped buckle of FIG. 13.

Referring now to FIGS. 13 and 14, a buckle 140 according to the present invention is illustrated in an assembled state. Female member 144 receives male member 145 in a latched position to clasp buckle 140. Female member 144 includes a catch extension 148 that cooperates with an opening 149 on male member 145. Male member 145 is disengaged from female member 144 when side tangs 142 are pinched together and center arm 143 is freed from catch extension 148. Center arm 143 is deflected away from catch extension 148 to be free of catch extension 148 to permit male member 145 to be disengaged. A button 147 acts as an actuator to deflect center arm 143 away from catch extension 148. Button 147 includes an actuating area 151 that contacts center arm 143 and displaces it away from catch extension 148. In an exemplary embodiment, a gap 152 is provided between actuating area 151 and center arm 143 so that button 147 moves through a non-operative range before actuating area 151 begins to influence center arm 143. Gap 152 accordingly provides a non-operative range for the actuation of button 147 to promote a child resistant feature where button 147 appears non-operative when a child attempts to actuate button 147.

Female member 144 includes a top wall 154 and a bottom wall 156 that contribute to support for the structural integrity of female member 144. In addition, male member 145 includes a tapered area near opening 149 to contribute to the operability of buckle 140. When center arm 143 is displaced away from catch extension 148, tapered area 141 contributes to easing the release of center arm 143 from catch extension 148 by providing additional clearance so that the latching mechanism operates with less deflection, and without the application of an overly burdensome force. Center arm 143 can generally remain at a thicker dimension than tapered area 141, so that the structural integrity of male member 145 is maintained, and center arm 143 provides a suitable resistance to actuation when button 147 is pressed. Through opening 149 also permits catch extension 148 to extend further than otherwise might be feasible, while maintaining a reversible feature. Catch extension 148 can extend into through opening 149 to contribute to securing male member 145 and female member 144. In this embodiment, at least two of the latching mechanisms are arranged on adjacent sides or surfaces of the buckle, and are not opposed to each other.

Figure 15:
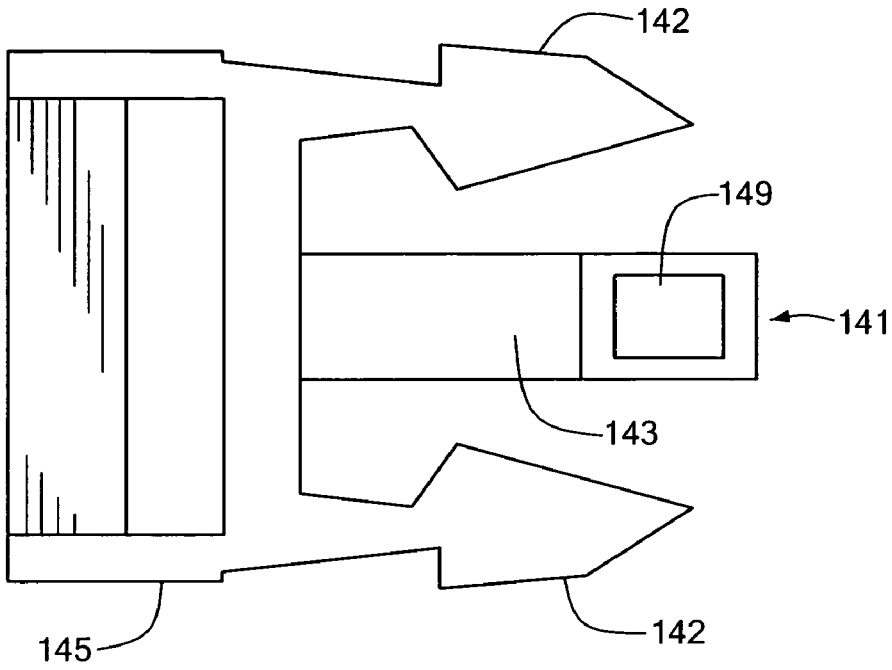
FIG. 15 is a plan view of a male buckle member according to the embodiment of FIG. 13.

Referring now to FIG. 15, another illustration of male member 145 is provided. Through opening 149 is shown on center arm 143 in tapered area 141 to serve as a latch member for securing male member 145 in buckle 140.

Figure 16:
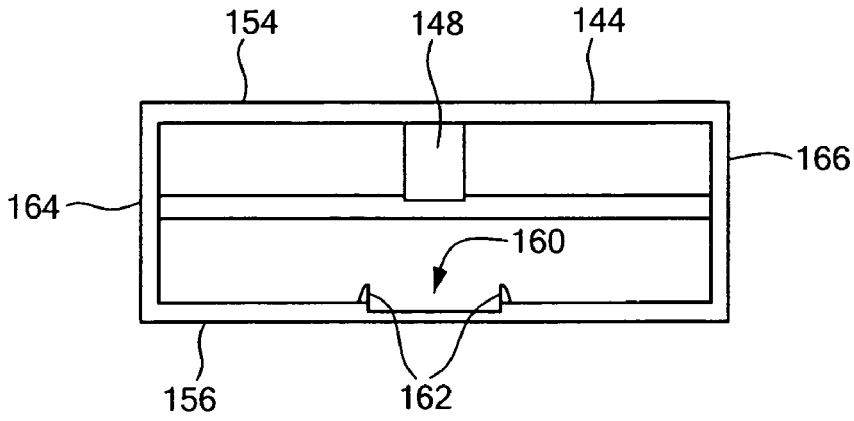
FIG. 16 is an elevation view of a female buckle member according to the embodiment of FIG. 13.

Referring to FIG. 16, female member 144 is illustrated with a view of an opening for receiving male member 145. Catch extension 148 is illustrated in the center of the view of female member 144 for engaging center arm 143 of male member 145. In addition, a slot or trench 160 is illustrated in a side of bottom wall 156. Trench 160 provides a clearance for the deflection of the center arm 143 when male member 145 is disengaged from female member 144. Accordingly, trench 160 eases the operation of center arm 143 during a disengagement operation to facilitate an easy unclasping operation. Female member 144 may also include guide rails 162 that project upward from bottom wall 156. Guide rails 162 help to guide center arm 143, and male member 145 into female member 144 without lateral rotation, and also tend to stabilize the clasped buckle to prevent inadvertent unclasping through rotation or other lateral forces. It should be apparent that guide rails 162 may be alternately or additionally positioned on a side of top wall 154 to improve stability, for example.

Because male member 145 is reversible, it may be inserted in female member 144 in any orientation and still achieve the objects and advantages of the present invention. An important goal of the buckles illustrated according to the present invention is that they be operable on an intuitive level by users that may be encountering the buckle for the first time. Accordingly, the buckle should be easy to operate and operate in a consistent manner. The reversible feature of the present invention permits the user to insert male member 145 into female member 144 in any orientation so that the intuitive operation of the buckle is improved. The cooperating features of through opening 149, catch extension 148, tapered area 141 and trench 160 serve to provide a robust latch mechanism, while facilitating a simple and convenient opening mechanism to unclasp buckle 140.

The above-described features can be made consistent when buckle 140 is produced with designs that allow flexibility and tolerances, and with materials that do not permanently deform over a significant amount of time. Accordingly, buckle 140 is designed to have structural features to prevent deformation of buckle 140, even when it is subjected to high impact and compressive loading. Because buckle 140 is made out of impact modified nylon in an exemplary embodiment, buckle 140 tends to be relatively pliable, which improves the resistance of the buckle to cracking, stress fractures, or breaking. In addition, side tangs 142, center arm 143 and catch extension 148 can be made more robust and thicker yet remain pliable to facilitate use, thereby improving durability while maintaining operative ease. Also, top and bottom walls 154, 156, as well as side walls 164, 166 of female member 144 can be made thicker to resist impact or compressive loading. Walls 154, 156, 164, 166 can also include structural elements to improve their resistance to loading, such as ribs, arc of thicker material, and the like. The structure of buckle 140 compensates for the pliability of the impact modified nylon so that buckle 140 can withstand higher external force loading, as well as wide variations in temperature and humidity as are typically experienced in outdoor use.

Figure 17:
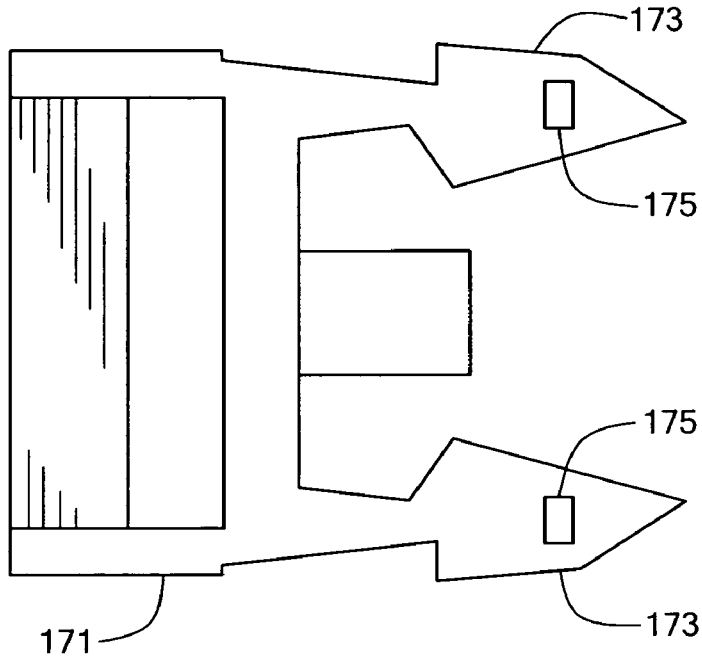
FIG. 17 is a plan view of a male buckle member according to another embodiment of the present invention.
Figure 18:
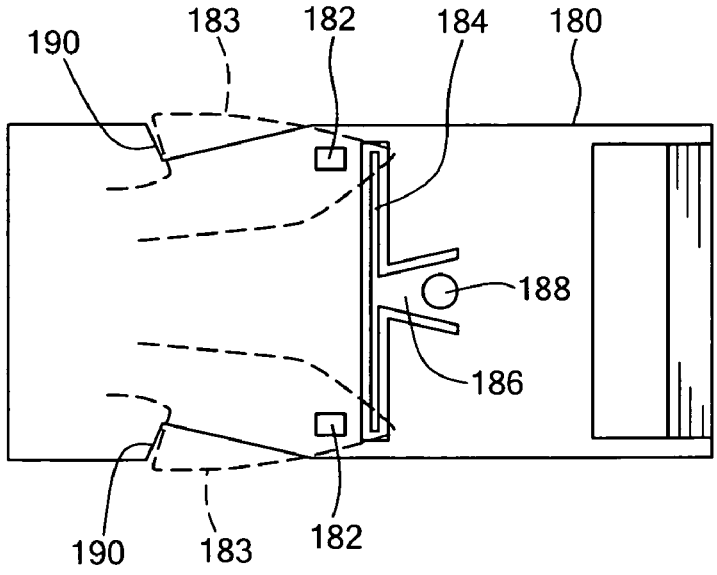
FIG. 18 is a plan view of a female buckle member cooperative with the member of FIG. 17.

Referring to FIGS. 17 and 18, another embodiment of the present invention is illustrated with male and female buckle components 171 and 180, respectively. Components 171 and 180 have cooperating latches and catches 175 and 182, respectively, that interact to form a second latch. The first latch, formed by side arms 173 and shoulders 190 operates as usual, with side arms 173 being pinched to be released from shoulders 190. A bar 184 on component 180 is actuated to displace side arms 173 to disengage second latches 175, 182. Latches 175, 182 may be in the form of protrusions and cooperative recesses, for example. The recesses and/or protrusions may be on either male or female components 171, 180. A spring bar 186 connected to bar 184 causes bar 184 to move when depressed, as by a button 188. It should be apparent that bar 184 may be configured to be below arms 173 so that actuation releases arms 173, similar to the embodiment shown in FIG. 12. Also, one or more latches may be used and the buckle remains reversible.

It should also be apparent that several bars 184 may be provided, for example to have one bar for each arm 173. In this way, there would be two latching mechanisms provided on a single side or surface of the buckle. In such a configuration, the buckle is a two-action buckle, the latching mechanisms being operable on one side or surface of the buckle alone, or in combination with the arms and shoulders on another side or sides of the buckle. Accordingly, a number of latching mechanisms can be provided on a single surface or side to obtain a two action and reversible buckle.

In designing a child resistant buckle, a number of factors may be observed as having an impact on child resistance. For example, the pressing force used to actuate a buckle may be set to contribute to child resistant features, as well as providing a two-action buckle or restraint to release a child resistant buckle. One factor that has not been identified until now is the orientation of the buckle in a child seat restraint. It has been found that the orientation of a buckle can add to the difficulty in opening a buckle in a child seat for the child. At the same time, the orientation of the buckle makes it easier for the person, presumably an adult, who is releasing the child to operate the buckle.

It is well documented that a majority of people are right handed by nature, including young children. The two-action reversible buckle according to the present invention is typically constructed with a plug and socket, or male and female portions. A user typically releases the buckle by pinching the side arms with the thumb and forefinger of one hand, while actuating the second latch with the other hand, typically with the thumb of the other hand. It has been found that children have a more difficult time opening these types of buckles when the left hand is used to attempt to pinch the side arms, and the right hand is used to actuate the second latch. The preference for actions using the right hand contributes to the difficulty faced by children using their left hand to pinch the side arms. Therefore, in accordance with the present invention, seatbelts with buckles with two-action opening functionality are installed in child seats so that when the child attempts to open the buckle, the left hand is used to pinch the side arms, and the right hand is used to actuate the second latch. This configuration makes the buckle generally more difficult for the child to open, and thus more child resistant.

While the buckle orientation discussed above is more difficult for a child to open, the orientation actually facilitates an adult or other person unbuckling the buckle. Typically, the person releasing the child from the seat faces the child, and is automatically presented with the easier orientation to open the buckle. The person typically pinches the side arms of the buckle with their right hand, while actuating the second latch with the left hand, making the buckle intuitive and easy to release, while having an improved child resistant feature.

To achieve the desired orientation for the seatbelt and child resistant buckle, the male portion of the buckle, or plug, is attached to be presented from the right side of the child in the seat. The female member, or socket, is attached to be presented from the left-hand side of the child in the seat. In this orientation, the child's more natural inclination in attempting to open the clasped buckle is to apply a squeezing force to the tangs with the left hand, while attempting to actuate the second latch with the right hand, resulting in a more difficult operation from the perspective of the child.

An adult or other person coupling the seatbelt and typically facing the seated child has the female member, or socket, presented on their right hand side, while the male member, or plug, is presented on the left hand side of the adult or other person operating the buckle and the seatbelt. Accordingly, when the buckle is clasped, the adult will more naturally open the buckle using their right hand to squeeze the tangs, while using their left hand to actuate the second latch to unclasp the buckle, leading to an easier operation of the buckle for the adult. Surprisingly, this simple feature of orientation accomplishes several goals of the present invention, such as making the buckle generally more difficult to open for a child, while also providing an intuitively simple way for an adult to unclasp the buckle.

In accordance with a particular feature of the present invention, a buckle and/or seatbelt is provided with indicia related to orientation of the buckle and/or seatbelt to obtain the above-described advantages with respect to orientation of a male and female buckle member. For example, the strap of the seatbelt may include a sewed on or otherwise attached label with instructions for use, warnings, etc. that are more easily read or properly presented to a user standing at the shopping cart when the seatbelt is secured to the shopping cart in a proper orientation according to the present invention. That is, the indicia is properly presented to the user when the female buckle member is attached on a right hand side, and the male buckle member is attached on a left hand side from a perspective of the user.

Similarly, indicia on the buckle may be provided, such as serial numbers, warnings or instructions, for example, to indicate the appropriate orientation of the seatbelt when the seatbelt is secured to the shopping cart in an orientation that achieves the advantages of the present invention. In this way, installation or maintenance of the seatbelt in a proper orientation is intuitive to the installation or maintenance personnel. The indicia on the seatbelt or buckle also serves as a redundant method for orienting the seatbelt to obtain the advantages of the present invention, beyond instructions provided in an installation guide for the seatbelt, for example. Accordingly, the provision of indicia to orient the seatbelt and buckle properly contributes to improving the child resistance of the seatbelt. The indicia helps to ensure that a proper orientation is maintained to enhance the child resistance of the seatbelt.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A child resistant buckle, comprising:

first and second buckle members shaped to be cooperatively joined in a clasped condition;

a plurality of latching mechanisms included in the first and second buckle member, each capable of being separately actuated;

the latching mechanisms arranged with a functional symmetry to permit the buckle members to be joined and clasped with the latching mechanisms in a plurality of orientations, wherein at least one latching mechanism comprises:

a central arm extending internal to the buckle in a clasped condition with a first engagement structure that is free of engagement in a first orientation and engaged with a cooperative second engagement structure in a second, different orientation;

a central arm catch being operable to releasably secure the first and second buckle members together in a clasped condition when the central arm cooperates with the central arm catch;

the central arm being received into a chamber of a mating buckle portion, whereby the central arm is relatively inaccessible;

a trench opposed to the central arm catch in one of the first or second buckle members suitable for receiving the central arm from the other of the first or second buckle members when the central arm is displaced for engaging or disengaging the central arm catch; and a disengagement device on one or more of the first or second buckle members and being operable to disengage the at least one latching mechanism, the disengagement device being integral with the one or more of the first or second buckle members.

2. The buckle according to claim 1, wherein each latching mechanism further comprises:

a plurality of engagement structures, with at least one engagement structure located on each of the first and second buckle members and operable to cooperate to clasp the buckle;

at least one engagement structure being composed of a pair of latch components, both being located on one of the first or second buckle members and related to each other whereby one of the pair engages a complementary latch structure on another of the first or second buckle members in a first relative orientation of the clasped buckle, and another of the pair engages the complementary latch structure on the another of the first or second buckle members in a second relative orientation of the clasped buckle, different from the first relative orientation.

3. The buckle according to claim 1, wherein one of the latching mechanisms further comprise an engagement structure arranged to be symmetrical about a buckle axis, whereby the first and second buckle portions may be clasped in a plurality of orientations about the buckle axis.

4. The buckle according to claim 1, wherein one of the latching mechanisms further comprises a pair of engagement structures symmetrical about an axis of the buckle, such that at least one of the pair engages a corresponding cooperative engagement structure when the buckle is in a clasped condition independent of orientation.

5. The buckle according to claim 1, wherein the central arm further comprises an engagement structure with a through opening for receiving a complementary engagement structure on the opposite first or second buckle member to releasably secure the first or second buckle members together in a clasped condition.

6. The buckle according to claim 1, wherein the central arm further comprises a taper near an end of the central arm to contribute to reducing a displacement sufficient for engaging or disengaging the central arm from the central arm catch.

7. The buckle according to claim 1, wherein the buckle is constructed of material comprising impact modified nylon.

8. A child resistant buckle, comprising:

a plurality of mating parts operable to be coupled together in a plurality of orientations with respect to each other, one of the mating parts comprising a projection received within a cavity of another of the mating parts when the mating parts are coupled together;

at least two latch mechanisms arranged such that they can be actuated in relatively orthogonal directions;

portions of one of the at least two latch mechanisms being located on the projection and being displaceable to permit disengagement the one of the at least two latch mechanisms; and a disengagement device on one or more of the mating parts and being operable to displace the projection to disengage the one of the latch mechanisms, wherein the disengagement device is integral with the one or more of the mating parts.

9. The buckle according to claim 8, further comprising a trench in one of the mating parts suitable for receiving a portion of one of the first one of the at least two latch mechanisms when the portion is displaced for engagement or disengagement.

10. The buckle according to claim 8, further comprising a portion of one of the latch mechanisms including a through opening for receiving a complementary portion of the one of the latch mechanisms to releasably secure the first or second buckle members together in a clasped condition.

11. The buckle according to claim 8, further comprising a taper in a portion of one of the latch mechanisms suitable for receiving a complementary portion of the one of the latch mechanisms when the portion is displaced for engagement or disengagement.

12. The buckle according to claim 8, wherein the buckle is composed of a material comprising impact modified nylon.

13. The buckle according to claim 8, wherein one or more of the latch mechanisms can be actuated through application of a force of from about 5.0 lbs to about 16 lbs.

14. The buckle according to claim 8, wherein one or more of the latch mechanisms further comprises a non-functional range of operation, such that the latch mechanism may be operated in the range without actuating the latch mechanism.

15. A child resistant buckle, comprising:

a plurality of mating parts operable to be coupled together in a plurality of orientations with respect to each other, one of the mating parts comprising a projection received within a cavity of another of the mating parts when the mating parts are coupled together;

a plurality of latch mechanisms included in the mating parts;

at least two latch mechanisms arranged such that one of the at least two latch mechanisms is actuated in a direction substantially within a first plane, and another of the at least two latch mechanisms is actuated in a direction substantially within a second plane, wherein the planes are not parallel;

portions of the at least two latch mechanisms being located on the projection and being displaceable to permit disengagement of a first one of the at least two latch mechanisms; and a disengagement device on one or more of the mating parts and being operable to displace the projection to disengage the first one of the latch mechanisms, wherein the disengagement device is integral with the one or more of the mating parts.

16. The buckle according to claim 15, wherein the buckle is composed of a material comprising impact modified nylon.

17. The buckle according to claim 16, further comprising a nonfunctional range of operation for a latching mechanism, such that the latching mechanism may be operated in the range without being disengaged when the latching mechanism is engaged.

18. The buckle according to claim 15, wherein at least one latching mechanism can be actuated with an application of a force of from about 5.0 lbs to about 16.0 lbs.

19. The buckle according to claim 1, wherein the latching mechanisms are provided on a same surface of the buckle in a clasped condition.

* * * * *